US006024127A

United States Patent [19]

Johnson

[11] Patent Number: 6,024,127

[45] Date of Patent: Feb. 15, 2000

[54] DOWN SPOUT CLEAN OUT ADAPTER

[75] Inventor: Wm. Ralph Johnson, Dallas, Tex.

[73] Assignee: Allied Irrigation, Inc., Dallas, Tex.

[21] Appl. No.: 09/137,556

[22] Filed: Aug. 20, 1998

[51] Int. Cl.[7] ..... E04D 13/08

[52] U.S. Cl. ..... 137/873; 137/357; 137/872; 52/16; 138/92; 138/94

[58] Field of Search ..... 137/357, 873, 137/872, 269, 271; 52/16; 138/92, 94

[56] References Cited

U.S. PATENT DOCUMENTS

| | | | |
|---|---|---|---|
| 60,005 | 11/1866 | Hicks et al. | 137/873 |
| 96,478 | 11/1869 | Perkins | 137/873 |
| 125,742 | 4/1872 | Lee | 137/873 |
| 142,832 | 9/1873 | Wuerz | 137/873 |
| 246,930 | 9/1881 | West | 137/873 X |
| 289,821 | 12/1883 | Fisher | 137/873 |
| 458,768 | 9/1891 | Weightman | 137/873 X |
| 608,765 | 8/1898 | Epple | 137/873 |
| 1,377,966 | 5/1921 | Hunter | 138/92 |
| 3,481,366 | 12/1969 | Mortonson | 137/873 |
| 3,990,474 | 11/1976 | Harms | 137/873 |

*Primary Examiner*—Stephen M. Hepperle
*Assistant Examiner*—John Bastianelli
*Attorney, Agent, or Firm*—Daniel V. Thompson

[57] ABSTRACT

A down spout clean out adapter (10) connectable to a bottom distal end of a leader (18). The down spout clean out adapter (10) having an adapter (12) which has an adapter upper front (12UF) having an adapter upper front opening (12UFA) and an adapter upper left (12UL) having an adapter left guide and an adapter upper right (12UR) having an adapter right guide and an adapter upper back (12UB). The down spout clean out adapter (10) further has a door (16) which has a door top (16T) and a door front (16F) and a door back (16B) and a door bottom (16A) and a door left (16L) and a door right (16R). The door (16) is removably positionable between the adapter left guide and the adapter right guide.

5 Claims, 3 Drawing Sheets

DOWN SPOUT CLEAN OUT ADAPTER

TECHNICAL FIELD

The present invention relates to an adapter between a gutter down spout and a drain pipe. More particularly, the present invention relates to a down spout clean out adapter having a vertical and horizontally positionable door.

BACKGROUND ART

Numerous innovations for pipe drains per present in the prior art. They have various configurations and sizes. Even though these innovations may be suitable for the specific individual purposes to which they address, they would not be suitable for the purposes of the present invention as hereafter described.

SUMMARY OF THE INVENTION

The present invention relates to a down spout clean out adapter having a vertical and horizontally positionable door. It is preferably constructed from styrene, ABS, or PVC which is rugged, won't rust, corrode, shatter or bend. Debris in the down spout exits the pipe rather than clogging up the drain pipe. Special guides inside the adapter receive the door in a horizontal position to redirect the water and debris flow outwardly.

The types of problems encountered in the prior art are adapters clog with debris such as leaves etc.

In the prior art, unsuccessful attempts to solve this problem were attempted namely: clean out Y-shaped valves. However, the problem was solved by the present invention because it is convertible into an out flow or in flow by simply repositioning the door.

Innovations within the prior art are rapidly being exploited in the field of drainage.

The present invention went contrary to the teaching of the art which describes straight non ported adapters.

The present invention solved a long felt need for a simple and easy device to purge drain pipes and leaders of debris while not allowing the debris to enter the down flow pipe system.

A synergistic effect was produced utilizing the present invention due to the following facts and results from experimentation: the rotting debris in the gutters make great fertilizer for the surrounding grass and vegetation.

Accordingly, it is an object of the present invention to provide a down spout clean out adapter having an adapter, a connector, and a door.

More particularly, it is an object of the present invention to provide the adapter having an adapter upper front, adapter upper left, adapter upper right, adapter upper back, adapter lower front, adapter lower left, adapter lower right, and adapter lower back.

In keeping with these objects, and with others which will become apparent hereinafter, one feature of the present invention resides, briefly stated, in the adapter upper front has an adapter upper front opening.

When the adapter upper left is designed in accordance with the present invention, it comprises an adapter upper left guide having an adapter upper left guide horizontal member and an adapter upper left guide vertical member.

In accordance with another feature of the present invention, the adapter upper right comprises an adapter upper right guide having an adapter upper right guide horizontal member and an adapter upper right guide vertical member.

Another feature of the present invention is that the adapter lower left comprises an adapter lower left guide having an adapter lower left guide horizontal member and an adapter lower left guide vertical member with an adapter lower left guide vertical member tab.

Yet another feature of the present invention is that the adapter lower right comprises an adapter lower right guide having an adapter lower right guide horizontal member and an adapter lower right guide vertical member with an adapter lower right guide vertical member tab.

Still another feature of the present invention is that the connector comprises a connector front, connector back, connector left, connector right, and connector collar.

Yet still another feature of the present invention is that the door comprises a door top, door front, door back, door bottom, door left, and door right.

Still yet another feature of the present invention is that the door front comprises a door front handle.

Another feature of the present invention is that the door left has a door left indent with a door left indent notch.

Yet another feature of the present invention is that the door right has a door right indent with a door right indent notch.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 3:
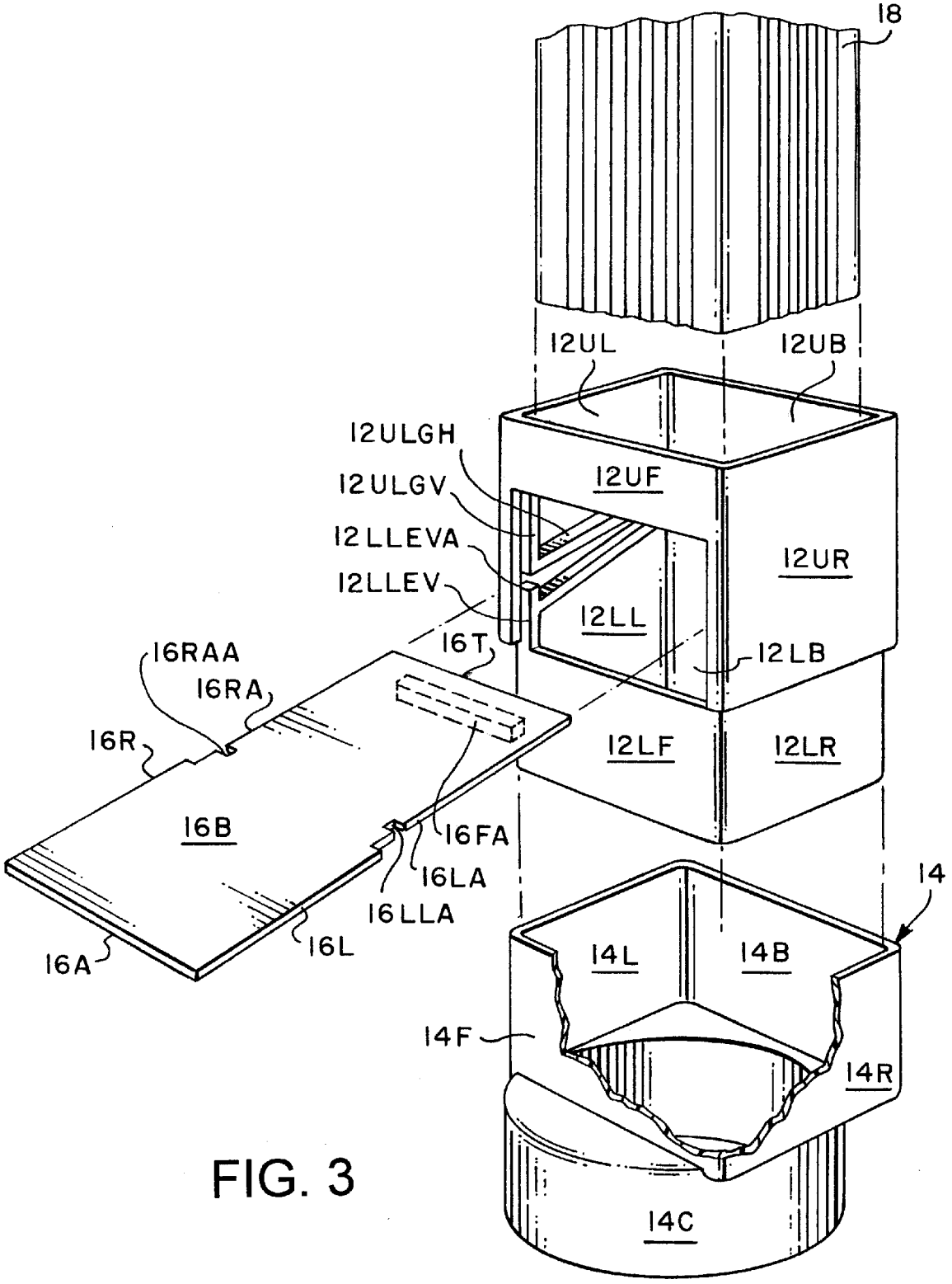
FIG. 3 is a top right exploded perspective view of a down spout clean out adapter (10) exhibiting the door (16) being inserted in a horizontal position.

Referring to FIG. 3 which is a top right exploded perspective view of a down spout clean out adapter (10) exhibiting the door (16) being inserted in a horizontal position. The down spout clean out adapter (10) connectable to a bottom distal end of a leader (18). The down spout clean out adapter (10) comprising an adapter (12) which comprises an adapter upper front (l2UF) having an adapter upper front opening (12UFA) and an adapter upper left (12UL) having an adapter left guide and an adapter upper right (12UR) having an adapter right guide and an adapter upper back (12UB).

The down spout clean out adapter (10) may optionally further comprise an adapter lower front (12LF) positioned under and inwardly from the adapter upper left (12UL) having a space therebetween slightly larger than a thickness of the door (16) and an adapter lower left (12LL) connected to and positioned under the adapter upper left (12UL) and an adapter lower right (12LR) connected to and positioned under the adapter upper right (12UR) and an adapter lower back (12LB) connected to and positioned under the adapter upper back (12UB).

The down spout clean out adapter (10) further comprises a door (16) which comprises a door top (16T) and a door front (16F) and a door back (16B) and a door bottom (16A) and a door left (16L) and a door right (16R). The door (16) is removably positionable between the adapter left guide and the adapter right guide. The door (16) comprises a door front handle (I6FA) positioned on a top of the door front (16F).

The door left (16L) preferably comprises a door left indent (16LA) and the door right (16R) comprises a door right indent (16RA). The door left indent (I6LA) and the door right indent (16RA) function to form a narrowing width slightly less than a width of the adapter upper front opening (12UFA). The door left (16L) preferably further comprises a door left indent notch (16LAA) having a complementary configuration top the adapter lower left guide vertical member tab (12LLG) engaging thereon when the door (16) is positioned horizontally.

The door right (16R) preferably further comprises a door right indent notch (16RAA) having a complementary configuration top the adapter lower right guide vertical member tab (not shown) engaging thereon when the door (16) is positioned horizontally.

The down spout clean out adapter (10) may optionally further comprise a connector (14) insertable into the adapter (12). The connector (14) comprises a connector front (I4F) and a connector back (14B) and a connector right (14R) and a connector left (14L) sealably connected at a bottom to a connector collar (14C) connectable to a pipe. If present, the connector (14) preferably comprises an upper diameter slightly larger then a diameter of the adapter (12).

The down spout clean out adapter (10) is preferably constructed from a material selected from a group consisting of plastic, plastic composite, rubber, rubber composite, metal, metal alloy, wood, wood composite, fiberglass, epoxy, and carbon-graphite.

Figure 1:
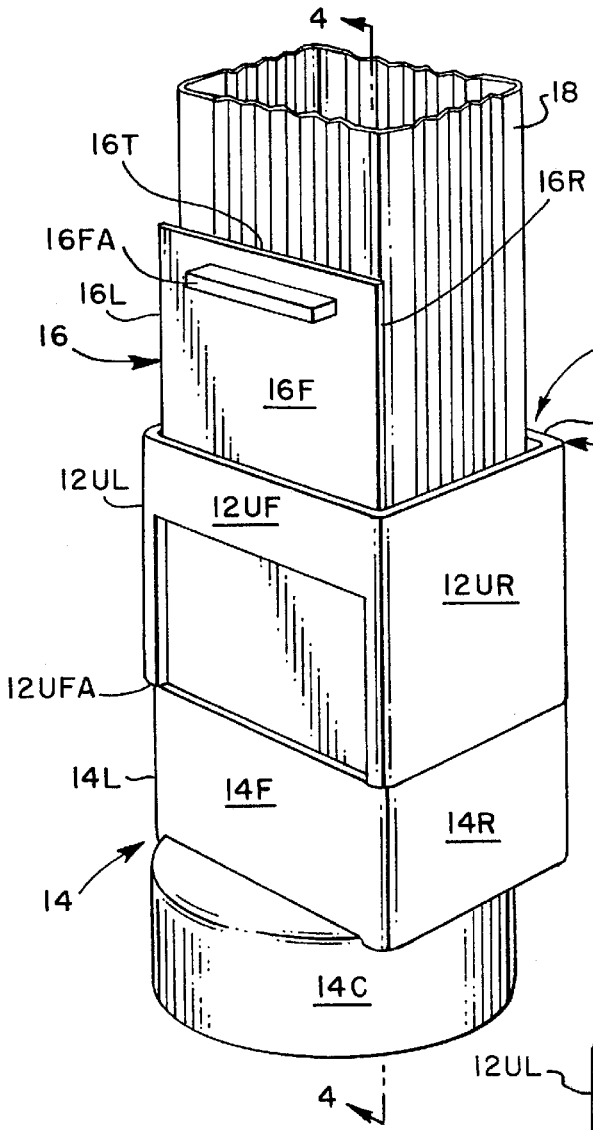
FIG. 1 is a top right perspective view of a down spout clean out adapter (10) exhibiting the door (16) in a vertical position.
Figure 4:
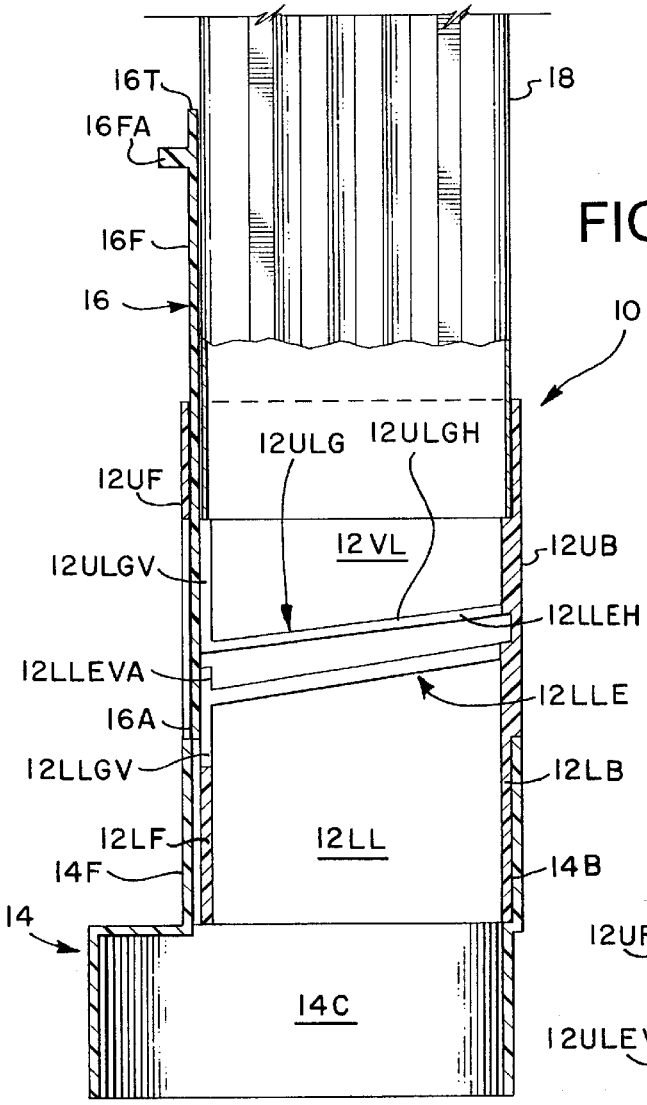
FIG. 4 is a cross sectional view of the down spout clean out adapter (10) along line 4—4 of FIG. 1 exhibiting the door (16) in a vertical position.

Now referring to FIG. 1 which is a top right perspective view of a down spout clean out adapter (10) exhibiting the door (16) in a vertical position and FIG. 4 which is a cross sectional view of the down spout clean out adapter (10) along line 4—4 of FIG. 1 exhibiting the door (16) in a vertical position. When a user positions the door (16) vertically between the adapter left guide and the adapter right guide and the adapter upper front (12UF). The adapter upper front opening (12UFA) is closed and effluent from the leader (18) passes downwardly through the down spout clean out adapter (10).

The adapter upper left (12UL) comprises an adapter upper left guide (12ULG) having an adapter upper left guide horizontal member (12ULGH) and an adapter upper left guide vertical member (12ULGV). The adapter upper right (12UR) comprises an adapter upper right guide (not shown) having an adapter upper right guide horizontal member (not shown) and an adapter upper right guide vertical member (not shown). The adapter lower left (12LL) comprises an adapter lower left guide (12LLG) having an adapter lower left guide horizontal member (12LLG) and an adapter lower left guide vertical member (12LLG). The adapter lower right (12LR) comprises an adapter lower right guide (not shown) having an adapter lower right guide horizontal member (not shown) and an adapter lower right guide vertical member (not shown), when the door (16) is in the vertical position. The door (16) is slidably positioned between the adapter upper left guide vertical member (12ULGV) and the adapter lower left guide vertical member (12LLG) and the adapter upper right guide vertical member (not shown) and the adapter lower right guide vertical member (not shown). When the door (16) is in the horizontal position, the door (16) is slidably positioned between the adapter upper left guide horizontal member (12ULGH) and the adapter lower left guide horizontal member (12LLG) and the adapter upper right guide horizontal member (not shown) and the adapter lower right guide horizontal member (not shown).

The adapter upper left guide horizontal member (12ULGH) and the adapter upper right guide horizontal member (not shown) and the adapter lower left guide horizontal member (12LLG) and the adapter lower right guide horizontal member (not shown) are preferably angled sloping slightly downwardly from the adapter back toward the adapter front facilitating egress of the effluent from the down spout clean out adapter (10) when the user inserts the door (16) horizontally on the adapter left guide and the adapter right guide (not shown).

Figure 2:
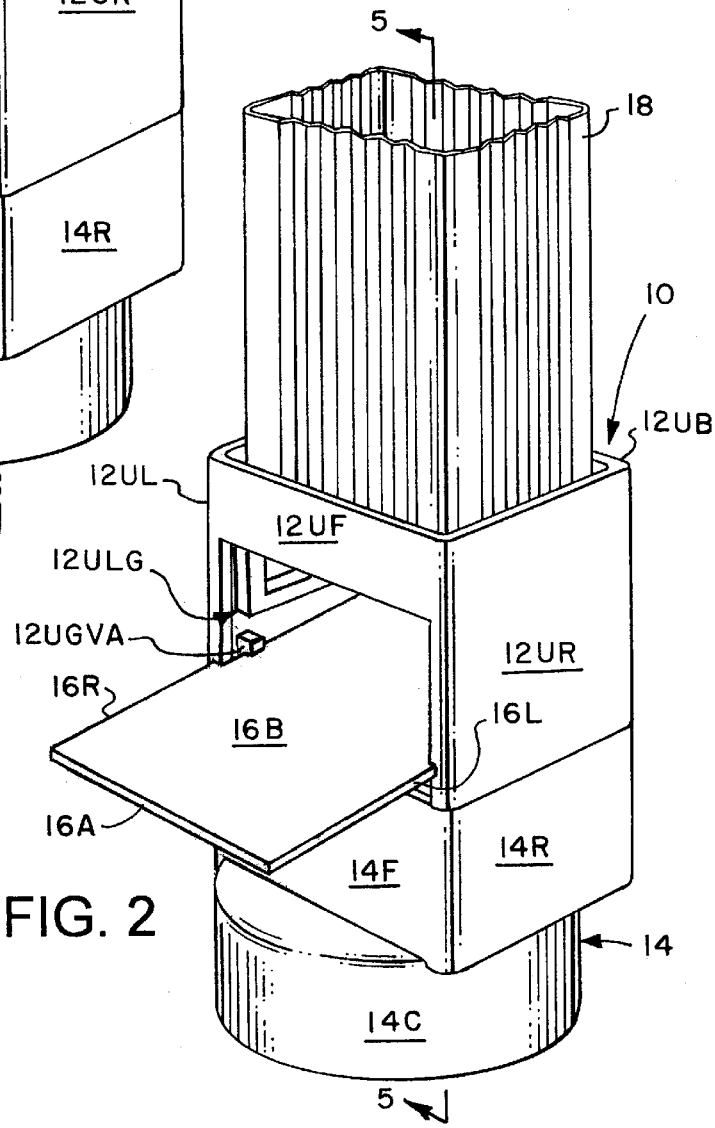
FIG. 2 is a top right perspective view of a down spout clean out adapter (10) exhibiting the door (16) in a horizontal position.
Figure 5:
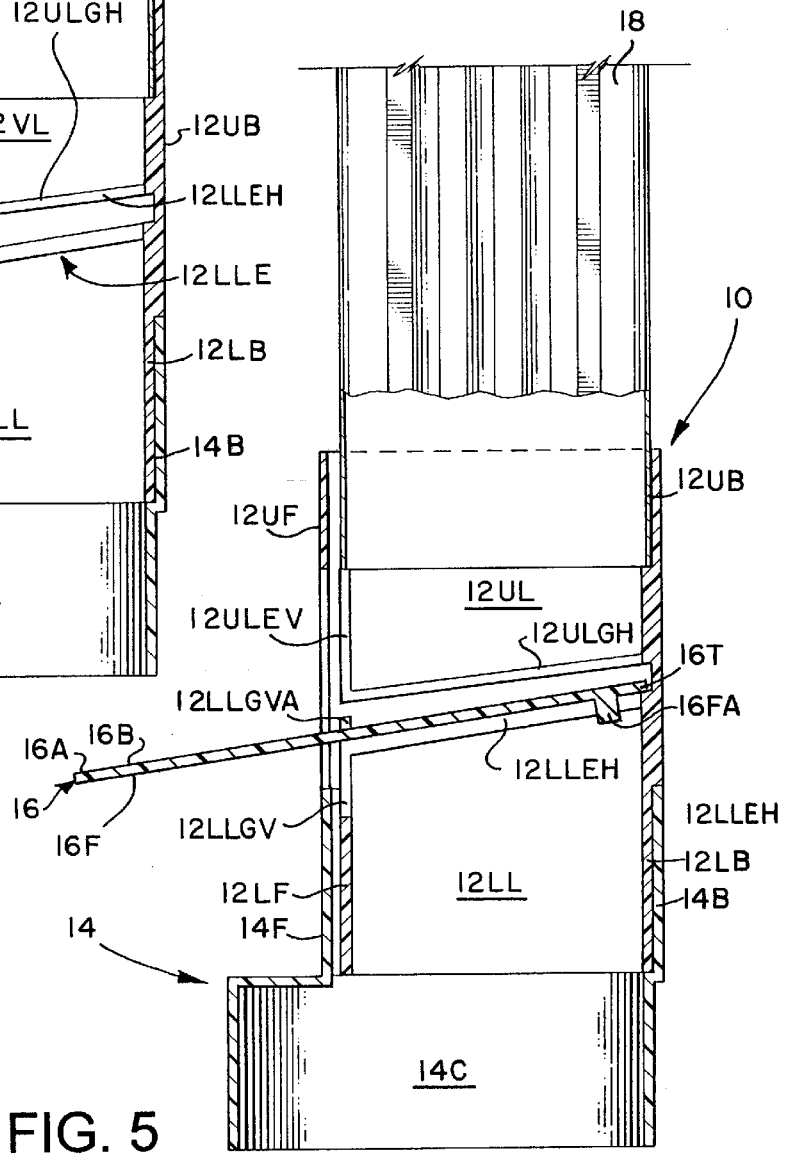
FIG. 5 is a cross sectional view of the down spout clean out adapter (10) along line 5—5 of FIG. 2 exhibiting the door (16) in a vertical position.

Referring to FIG. 2 which is a top right perspective view of a down spout clean out adapter (10) exhibiting the door (16) in a horizontal position and FIG. 5 which is a cross sectional view of the down spout clean out adapter (10) along line 5—5 of FIG. 2 exhibiting the door (16) in a vertical position. When the user positions the door (16) horizontally on the adapter left guide and the adapter right guide. The adapter upper front opening (12UFA) is open and effluent from the leader (18) passes outwardly through the adapter upper front opening (12UFA). The adapter lower left guide vertical member (12LLG) comprises an adapter lower left guide vertical member tab (12LLG) and the adapter lower right guide vertical member (not shown) comprises an adapter lower right guide vertical member tab (not shown).

It will be understood that each of the elements described above, or two or more together, may also find a useful application in other types of constructions differing from the type described above.

While the invention has been illustrated and described as embodied in an adapter, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

I claim:

1. A down spout clean out adapter (10) connectable to a bottom distal end of a leader (18) the down spout clean out adapter (10) comprising:

A) an adapter (12) which comprises an adapter upper front (12UF) having an adapter upper front opening (12UFA) and an adapter upper left (12UL) having an adapter left guide and an adapter upper right (12UR) having an adapter right guide and an adapter upper back (12UB);

B) a door (16) which comprises a door top (16T) and a door front (16F) and a door back (16B) and a door bottom (16A) and a door left (16L) and a door right (16R), the door (16) is removably positionable between the adapter left guide and the adapter right guide, when a user positions the door (16) vertically between the adapter left guide and the adapter right guide and the adapter upper front (12UF), the adapter upper front opening (12UFA) is closed and effluent from the leader (18) passes downwardly through the down spout clean out adapter (10), when the user positions the door (16) horizontally on the adapter left guide and the adapter right guide, the adapter upper front opening (12UFA) is open and effluent from the leader (18) passes outwardly through the adapter upper front opening (12UFA); and with an adapter lower front (12LF) positioned under and inwardly from the adapter upper front (12UF) having a space therebetween slightly larger than a thickness of the door (16) and an adapter lower left (12LL) connected to and positioned under the adapter upper left (12UL) and an adapter lower right (12LR) connected to and positioned under the adapter upper right (12UR) and an adapter lower back (12LB) connected to and positioned under the adapter upper back (12UB); and wherein the adapter upper left (12UL) comprises an adapter upper left guide (12ULG) having an adapter upper left guide horizontal member (12ULGH) and an adapter upper left guide vertical member (12ULGV), the adapter upper right (12UR) comprises an adapter upper right guide having an adapter upper right guide horizontal member and an adapter upper right guide vertical member the adapter lower left (12LL) comprises an adapter lower left guide (12LLG) having an adapter lower left guide horizontal member (12LLG) and an adapter lower left guide vertical member (12LLG), the adapter lower right (12LR) comprises an adapter lower right guide having an adapter lower right guide horizontal member and an adapter lower right guide vertical member, when the door (16) is in the vertical position, the door (16) is slidably positioned between the adapter upper left guide vertical member (12ULGV) and the adapter lower left guide vertical member (12LLG) and the adapter upper right guide vertical member and the adapter lower right guide vertical member, when the door (16) is in the horizontal position, the door (16) is slidably positioned between the adapter upper left guide horizontal member (12ULGH) and the adapter lower left guide horizontal member (12LLG) and the adapter upper right guide horizontal member and the adapter lower right guide horizontal member.

2. A down spout clean out adapter (10) connectable to a bottom distal end of a leader (18), the down spout clean out adapter (10) comprising:

A) an adapter (12) which comprises an adapter upper front (12UF) having an adapter upper front opening (12UFA) and an adapter upper left (12UL) having an adapter left guide and an adapter upper right (12UR) having an adapter right guide and an adapter upper back (12UB);

B) a door (16) which comprises a door top (16T) and a door front (16F) and a door back (16B) and a door bottom (16A) and a door left (16L) and a door right (16R), the door (16) is removably positionable between the adapter left guide and the adapter right guide, when a user positions the door (16) vertically between the adapter left guide and the adapter right guide and the adapter upper front (12UF), the adapter upper front opening (12UFA) is closed and effluent from the leader (18) passes downwardly through the down spout clean out adapter (10), when the user positions the door (16) horizontally on the adapter left guide and the adapter right guide the adapter upper front opening (12UFA) is open and effluent from the leader (18) passes outwardly through the adapter upper front opening (12UFA);

further comprising a connector (14) insertable into the adapter (12), the connector (14) comprises a connector front (14F) and a connector back (14B) and a connector right (14R) and a connector left (14L) sealably connected at a bottom to a connector collar (14C) connectable to a pipe; and wherein the connector (14) comprises an upper diameter slightly larger then a diameter of the adapter (12).

3. The down spout clean out adapter (10) as described in claim 1, wherein the adapter upper left guide horizontal member (12ULGH) and the adapter upper right guide horizontal member and the adapter lower left guide horizontal member (12LLG) and the adapter lower right guide horizontal member are angled sloping slightly downwardly from the adapter back toward the adapter front facilitating egress of the effluent from the down spout clean out adapter (10) when the user inserts the door (16) horizontally on the adapter left guide and the adapter right guide.

4. A down spout clean out adapter (10) connectable to a bottom distal end of a leader (18), the down spout clean out adapter (10) comprising:

A) an adapter (12) which comprises an adapter upper front (12UF) having an adapter upper front opening (12UFA) and an adapter upper left (12UL) having an adapter left guide and an adapter upper right (12UR) having an adapter right guide and an adapter upper back (12UB);

B) a door (16) which comprises a door top (16T) and a door front (16F) and a door back (16B) and a door bottom (16A) and a door left (16L) and a door right (16R), the door (16) is removably positionable between the adapter left guide and the adapter right guide, when a user positions the door (16) vertically between the adapter left guide and the adapter right guide and the adapter upper front (12UF), the adapter upper front opening (12UFA) is closed and effluent from the leader (18) passes downwardly through the down spout clean out adapter (10), when the user positions the door (16) horizontally on the adapter left guide and the adapter right guide, the adapter upper front opening (12UFA) is open and effluent from the leader (18) passes outwardly through the adapter upper front opening (12UFA); and wherein the door left (16L) comprises a door left indent (16LA) and the door right (16R) comprises a door right indent (16RA), the door left indent (16LA) and the door right indent (16RA) function to form a narrowing width slightly less than a width of the adapter upper front opening (12UFA).

5. The down spout clean out adapter (10) as described in claim 4, wherein the door right (16R) further comprises a door right indent notch (16RAA) having a complementary configuration to the adapter lower right guide vertical member tab engaging thereon when the door (16) is positioned horizontally.

* * * * *